US005732968A

United States Patent [19]

Wladar et al.

[11] Patent Number: 5,732,968

[45] Date of Patent: Mar. 31, 1998

[54] APPARATUS FOR THE LONGITUDINAL ADJUSTMENT

[75] Inventors: Helmut Wladar; Johann Zotter, both of Vienna; Andreas Janisch, Oeynhausen; Karl Stritzl, Vienna; Hubert Wuerthner, Hainburg; Franz Luschnig, Traiskirchen; Reinhold Wawra, Vienna; Alois Himmetsberger, Vienna; Heinz Stadler, Vienna; Henry Freisinger, Vienna, all of Austria

[73] Assignee: HTM Sport- und Freizeitgeraete Aktiengesellschaft, Schwechat, Austria

[21] Appl. No.: 581,535

[22] PCT Filed: May 2, 1995

[86] PCT No.: PCT/EP95/01660

§ 371 Date: Jan. 11, 1996

§ 102(e) Date: Jan. 11, 1996

[87] PCT Pub. No.: WO95/30459

PCT Pub. Date: Nov. 16, 1995

[30] Foreign Application Priority Data

May 9, 1994 [AT] Austria ..... 967/94
Sep. 8, 1994 [AT] Austria ..... 1720/94

[51] Int. Cl.[6] ..... A63C 9/081

[52] U.S. Cl. ..... 280/633; 280/618

[58] Field of Search ..... 280/618, 620, 280/633, 634; 441/70

[56] References Cited

U.S. PATENT DOCUMENTS

| | | | |
|---|---|---|---|
| 3,125,349 | 3/1964 | Schweizer . | |
| 3,635,485 | 1/1972 | Gertsch et al. . | |
| 4,506,905 | 3/1985 | Krob et al. | 280/633 |
| 4,681,339 | 7/1987 | Himmetsberger et al. . | |
| 4,756,545 | 7/1988 | Freisinger et al. | 280/618 |
| 4,817,981 | 4/1989 | Desbiolles et al. | 280/616 |
| 4,955,633 | 9/1990 | Stritzl et al. | 280/633 |
| 5,056,808 | 10/1991 | Holzl et al. | 280/617 |
| 5,056,809 | 10/1991 | Brischoux et al. | 280/617 |
| 5,116,073 | 5/1992 | Goud | 280/617 |
| 5,188,388 | 2/1993 | Rohrmoser | 280/633 |
| 5,192,090 | 3/1993 | Damborsky . | |
| 5,348,335 | 9/1994 | Dasarmaux et al. | 280/633 |

FOREIGN PATENT DOCUMENTS

| | | | |
|---|---|---|---|
| 380639 | 6/1986 | Austria | 280/633 |
| 2123966 | 9/1972 | France | 280/633 |
| 2 632 200 | 12/1989 | France . | |
| 2 683 457 | 5/1994 | France . | |
| 43-17191 | 7/1968 | Japan . | |

*Primary Examiner*—Brian L. Johnson
*Assistant Examiner*—Bridget Avery
*Attorney, Agent, or Firm*—Flynn, Thiel, Boutell & Tanis, P.C.

[57] ABSTRACT

A longitudinal-adjusting device (1) for a ski-binding part (7) consists of a guide rail (2) fastened on a ski (3), on which an adjusting plate (5) is guided movably and lockably, which adjusting plate carries the ski-binding part (7). A locking part (10) is supported movably transversely with respect to the longitudinal direction of the ski in the adjusting plate (5), which locking part has locking teeth (12) on the underside, which teeth engage locking teeth (13) on the upper side of the guide rail (2). The locking part (10) is loaded by a spring (15) and has an operating member (18) with two surfaces (22, 23), which rest on a lateral section (21) of the adjusting plate (5).

15 Claims, 6 Drawing Sheets

APPARATUS FOR THE LONGITUDINAL ADJUSTMENT

FIELD OF THE INVENTION

The invention relates to a device for the longitudinal adjustment of a ski-binding part, in particular of a front jaw, including a guide rail fastened on the upper side of a ski, and on which the ski-binding part is guided in the longitudinal direction of the ski as a movable jaw unit, and can be fixed in a predetermined slide position on the guide rail by a locking mechanism having a locking part movably guided at a right angle with respect to the guide rail on the jaw unit, with an operating member hinged to said locking part, which operating member can be moved through the force of a spring into a form-locking engagement selectively with one of the complementary locking recesses of the guide rail arranged one behind the other in longitudinal direction of the ski, whereby the operating member has at least two surface sections, of which the second surface section extends relative with respect to the first surface section at an angle, which has the same size or is larger than 90°, and whereby the second surface section lies farther from the locking part than the first surface section, and thus the first surface section determines the locked and the second surface section the unlocked position of the locking part.

BACKGROUND OF THE INVENTION

Such a device is known from the AT-PS 380 639 and has proven to be successful in practice since the locked or unlocked position of the locking part is determined or fixed by two defined end positions of the operating member. The operating member is thereby pivotal about a horizontal axis supported on the jaw unit and the entire locking device is integrated in the front jaw. Thus the space needed for the locking device and the design of the operating member with the two surface sections used for its support must be newly considered for each type of front jaw. This means, however, that an individual construction is required for each jaw type.

An improved embodiment of the above device has become known from the AT-PS 396 432 disclosing that it is possible to not only adjust the front jaw, but also a heel holder through a connecting band in longitudinal direction of the ski by having three defined positions of the operating member determine the position of the locking part. Both the front jaw and also the heel holder are locked in the first position, in the second position is, for example, the heel holder unlocked whereas the front jaw remains locked, and in the third position both the heel holder and also the front jaw are unlocked. Also for this solution it is necessary to newly consider the space needed for the locking mechanism for each type of front jaw.

DE-OS 1 954 512 describes a locking mechanism for ski-binding parts built into an adjusting plate movable on the guide rail, which plate is intended for fastening of a ski-binding part so that various types and sizes of ski-binding parts can be selectively mounted thereon. The locking mechanism consists of a lock transversely movable with respect to the longitudinal axis of the ski, which lock engages one arm of a two-arm lever, the second arm of which is designed as a locking part, whereby the lock is loaded in longitudinal direction of the ski by a spring so that the locking part or rather its teeth are pressed against a row of teeth on the guide rail. If the teeth or rather the tooth gaps of the row of teeth are covered by snow, ice or dirt, an incomplete reciprocal engagement takes place, thus not guaranteeing the locking of the ski-binding part.

A similar locking mechanism has become known from FR-OS 2 683 457, in which the locking mechanism is also integrated into an adjusting plate. A lock, which is movable transversely with respect to the longitudinal axis of the ski, has two teeth engaging the spaces of a row of teeth of the guide rail. The lock is spring-loaded and has an operating button. A third tooth, arranged offset between the two teeth, is used as a stop for the lock. In order to make sure that the lock is completely unlocked, the button must be completely pressed in and must be held against the spring force in this position during the entire adjusting phase of the ski-binding part, for example, adjusting the front jaw.

SUMMARY OF THE INVENTION

The purpose of the invention is to produce a device for the longitudinal adjustment of a ski-binding part, which unites the advantages of an adjusting plate, as for example, easy exchange capability of a ski-binding part with another one of a different size and/or type, with the advantages of a locking mechanism with a secure locking and unlocking in respective stable positions using one hand for the operation.

The invention is based on a device for the longitudinal adjustment of a ski-binding part, in particular a front jaw, having a guide rail which can be fastened on the upper side of a ski, and on which the ski-binding part is guided in the longitudinal direction of the ski as a movable jaw unit and can be fixed in a predetermined slide position on the guide rail by a locking mechanism. The locking mechanism has a locking part which is movably guided at a right angle with respect to the guide rail on the jaw unit, and an operating member hinged to the locking part, which operating member can be moved through the force of a spring into a form-locking engagement selectively with one of the complementary locking recesses of the guide rail. The recesses are arranged one behind the other in longitudinal direction of the ski. The operating member is provided with at least two surface sections, of which the second surface section extends relative with respect to the first surface section at an angle, which has the same size or is larger than 90°. The second surface section lies farther from the locking part than the first surface section, and thus the first surface section determines the locked position and the second surface section determines the unlocked position of the locking part. The purpose is attained according to the invention with the jaw unit having an adjusting plate with a front jaw releasably fastenable to the same and the locking mechanism is arranged in the adjusting plate. Both the locking part and the complementary locking recesses extend horizontally. The operating member for disengaging the locking part from the complementary locking recesses is arranged pivotally about a vertical axis on the locking part. The operating member can be supported with its surface sections on a lateral section of the adjusting plate which lateral section faces the operating member.

In this manner the necessity to create for each jaw type, an individual construction of locking device and operating member, no longer exists. Thus it is possible with these measures to mount or remove various types of ski-binding parts in a simple manner on or from the adjusting plate, since the locking mechanism is independent from the ski-binding part integrated into the adjusting plate, whereby at the same time a secure locking and unlocking into or from the respective stable positions using one hand for the operation is guaranteed. By arranging the locking part and the complementary locking recesses in the horizontal, a low assembly height of the adjusting plate can be achieved. Since thereby the swinging out and the swinging in of the operating member occurs in the horizontal, a favorable ergonomic handling of the same is furthermore possible.

A further object of the invention is a favorable solution for the arrangement of the locking part or rather for the support of the same in the adjusting plate.

A further object of the invention is a compact design of the adjusting plate with the operating member, so that no interfering parts project over the adjusting plate or the ski part.

A further purpose of the invention is that the two ski-binding parts, namely the front jaw and the heel holder, are longitudinally movable in a first unlocked position individually, namely either the front jaw or the heel holder, or in a second unlocked position both simultaneously and independently of one another.

Due to the fact that the operating member has according to the invention, a third surface section, the locking part can be locked on the guide rail in two active positions. However, it is also guaranteed in this manner that it is possible to adjust in a first unlocked position the connecting band with the heel holder by itself, and in a second unlocked position additionally adjust the jaw unit in longitudinal direction of the ski also. Finally, it is possible to again lock together the jaw unit and the heel holder in the desired newly adjusted position, which, for example, centers the entire binding with respect to the ski.

A further object of the invention is directed toward a simple way to determine the structural assembly of the individual surface sections relative to the pin, dependent upon the length of the locking teeth on the connecting band or on the guide rail, and thus of the length of the locking teeth of the locking part.

A further object of the invention is directed toward particular structural measures, by which in unintended swinging out of the operating member is prevented.

The invention also relates to a further development of the above-mentioned device for the longitudinal adjustment of a ski-binding part, in particular of a front jaw, which is fastened on an adjusting plate movably guided and can be locked in a guide rail fastened on the ski.

The invention has the further purpose to create a damping device for an adjusting plate guided and locked in a guide rail, in order to achieve a damping action between the ski-binding part and the adjusting plate and as a further consequence through the guide rail to the ski.

This purpose is attained by providing an elastic damping insert secured against movement on the longitudinal direction of the ski. By arranging and placing the damping insert into the adjusting plate the former is active also at different adjustments of the latter to various shoe sizes.

A plurality of damping devices in the area of ski-binding parts are indeed known. For example, a device for fastening of ski-binding parts on a ski is known from the Jap. Patent Publication No. 43-17191 (of Jul. 16, 1968). A metallic ski-binding part is thereby connected through a soft-elastic part to the ski by means of screws. With this structure a damping action is achieved on the one hand and on the other hand, a corrosion of the ski-binding part is prevented. When travelling through a turn or curves, one component of the pressure applied by the weight of the skier onto the ski acts in such a manner that the soft-elastic plate is laterally compressed thus creating a horizontal force component, which outwardly presses the ski in an undesired manner out of the curve.

With the damping insert being embedded in a recess in the upper side of the adjusting plate with a base projecting over the upper side for supporting the front jaw, it is possible in an advantageous manner to maintain the assembly height of the adjusting plate relative to the upper side of the ski.

Further objects of the invention are two advantageous structural solutions for the simple mounting and securing of the damping insert. Furthermore, a direct damping action between the adjusting plate and the ski is achieved when the ski bends more, so that the damping insert contacts under the edge of the adjusting plate the upper side of the ski.

The further object of the invention is to prevent snow or ice from penetrating between the front jaw and the damping insert.

BRIEF DESCRIPTION OF THE DRAWINGS

The drawings show preferred embodiments of the invention.

DETAILED DESCRIPTION

Figure 1:
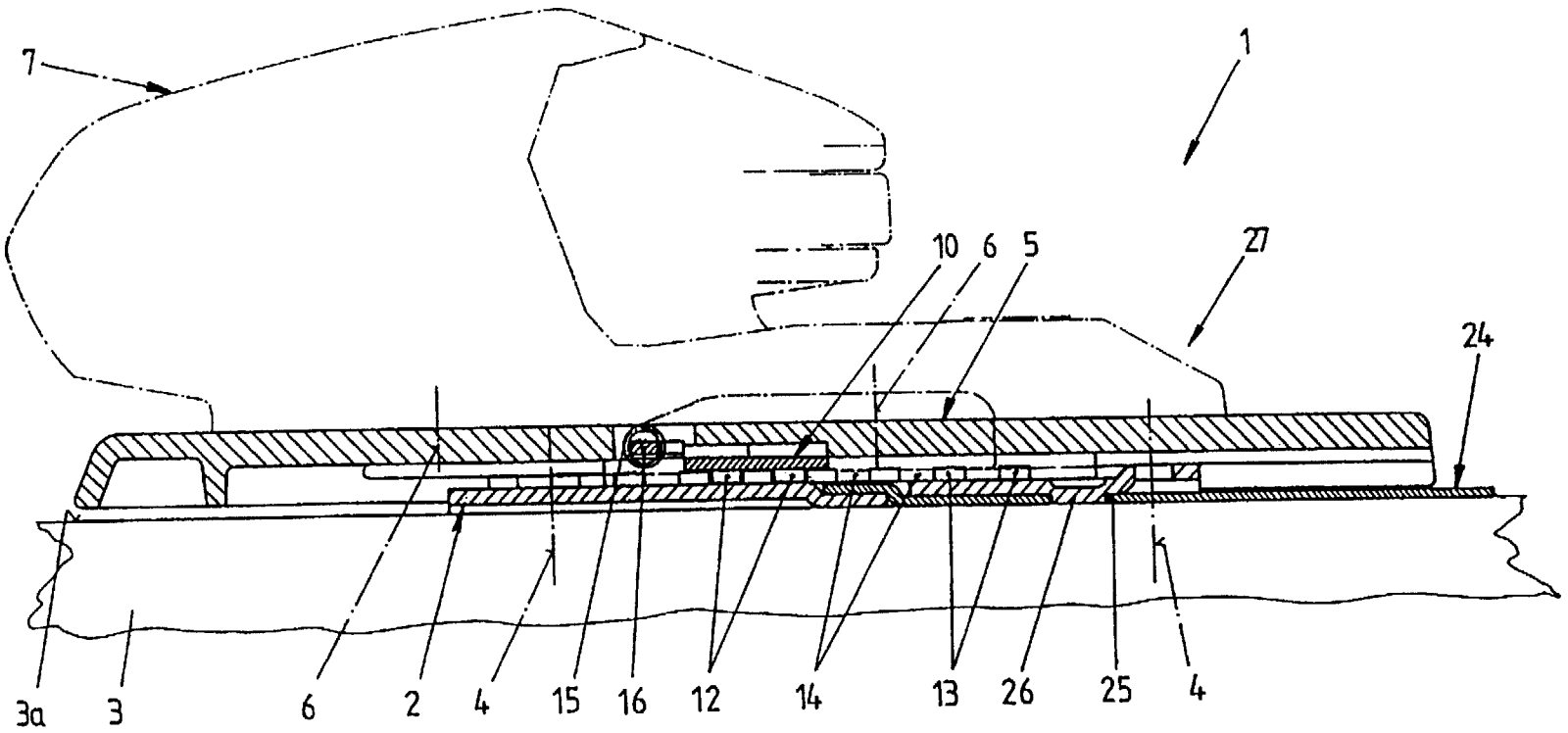
FIG. 1 is a vertical longitudinal center cross-sectional view of a first device of the invention.
Figure 2:
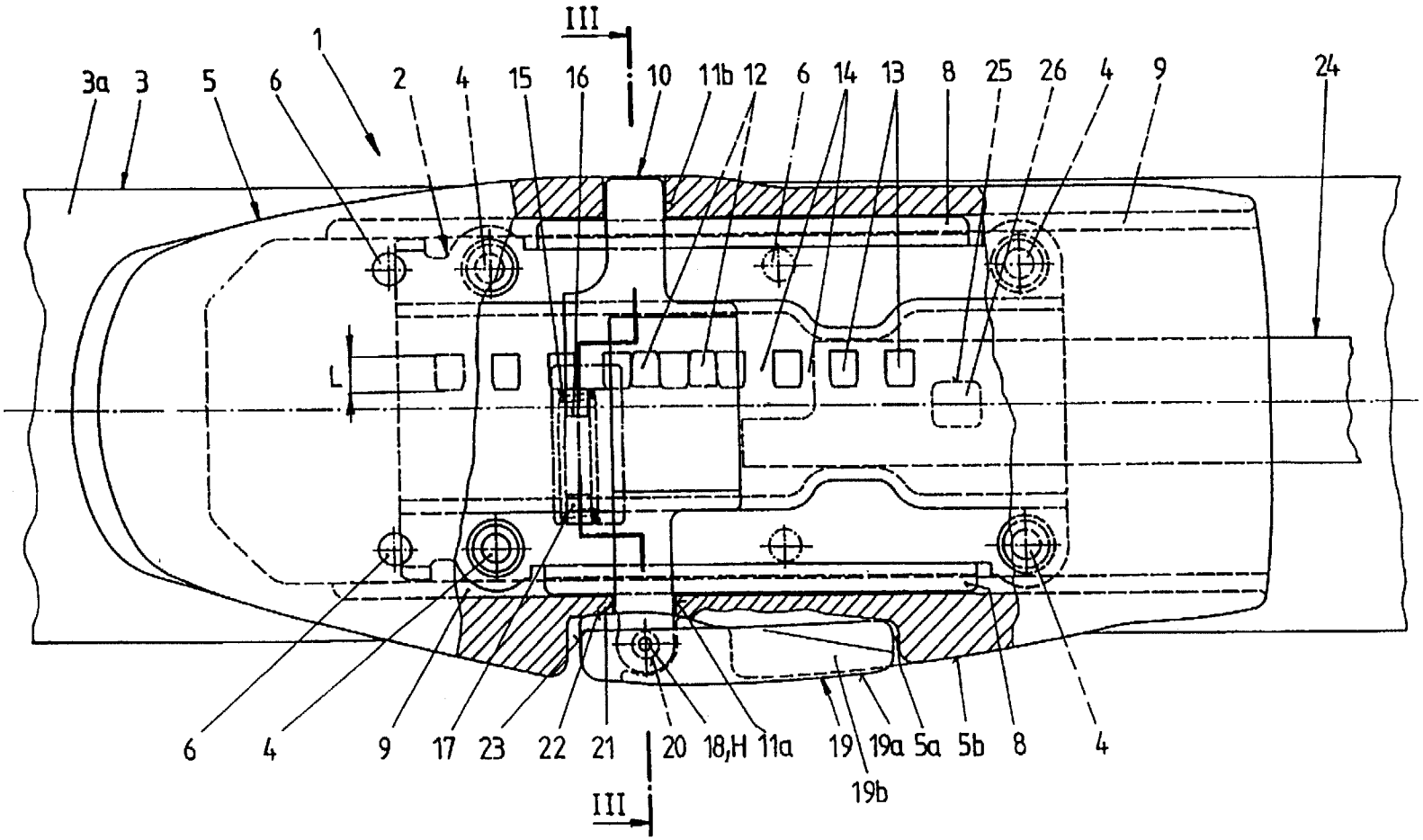
FIG. 2 is a top view of FIG. 1 partially in cross section.
Figure 3:
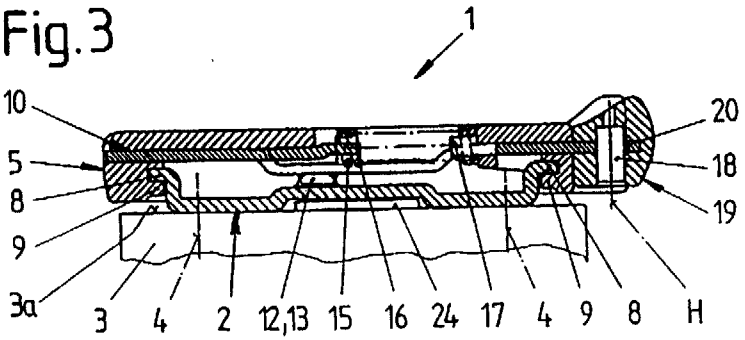
FIG. 3 is a cross-sectional view along the line III—III of FIG. 2.

A device for the longitudinal adjustment is identified in its entirety with reference numeral 1 in FIGS. 1 to 3. The device 1 consists of a guide rail 2, which is almost U-shaped in cross section and is fastened on the upper side 3*a* of a ski 3 by means of screws, and an adjusting plate 5 longitudinally movably supported on the guide rail 2 and has four bores 6 to receive screws for fastening a front jaw 7. For the movable support of the adjusting plate 5 on the guide rail 2, the latter has lateral extensions 8, into which the grooves 9 of the adjusting plate 5 engage (FIG. 3).

Each guide 11*a*, 11*b* is constructed in the lateral wall parts of the adjusting plate 5. A locking part 10 is supported transversely with respect to the longitudinal axis of the ski in the guides. The locking part carries two locking teeth 12 on its underside, which teeth selectively engage two complementary locking recesses 14 constructed by several locking teeth 13 arranged on the upper side of the guide rail 2. In order to hold the locking part 10 in the locked position, a spring 15 is provided in the form of a compression spring, which is held on one side by an extension 16 of the locking part 10 and on the other side by a peg 17 of the adjusting plate 5, and is supported by the locking part 10 or rather adjusting plate 5. FIGS. 2 and 3 show that the locking part 10 is laterally guided out of the adjusting plate 5 and carries at its end section, by means of a pin 18, an operating member 19 designed like a rocking lever. The pin 18 is inserted into a bore 20 of the locking part 10, which thus forms a vertical axis H, about which the operating member 19 is pivotally supported. The operating member 19 rests thereby in its locked position, illustrated in FIG. 2, with a first surface section 22 on a lateral section 21 of the adjusting plate 5. A second surface section 23 is constructed at a right angle with respect to the surface section 22 on the front side of the operating member 19, the normal distance of the second section 23 from the pin 18 is greater than the one of the first surface section 22.

A metallic connecting band 24 is provided for the flexible connection of the front jaw 7 to a heel holder, not illustrated in this embodiment, which connecting band has a square recess 25 at its front end, which recess engages in order to create a form-locking connection, a complementarily constructed projection 26 on the underside of the guide rail 2.

As has been mentioned above, the position of the operating member 19 and thus of the locking part 10, which position is shown in FIG. 2, corresponds with the locked state of the device 1. The operating member 19 is pivoted 90° in clockwise direction for unlocking, which causes the second surface section 23 to lie or be supported on the lateral section 21 of the adjusting plate 5. Since the second surface section 23, as mentioned above, is spaced a greater distance from the pin 18, the locking part 10 is pulled out of the adjusting plate 5 by the difference in the distance. This difference in the distance equals or is greater than the length L of the locking teeth 12 or 13 so that the locking part 10 is unlocked from the guide rail 5. Thus two stable end positions are obtained, which are caused by the bearing of the first and second surface sections 22 and 23 on the lateral section 21 of the adjusting plate, which simplifies the handling and protects against an unintended unlocking or locking.

As is particularly shown in FIG. 2, the adjusting plate 5 has for receiving the operating member 19 in its swung-in position a recess 5a and the operating member 19 swung into the recess 5a extends with its outside 19a flush with the outer contour 5b of the adjusting plate 5. A handle bar 19b on the operating member 19 tapers in its width toward the free end of the operating member 19 in order to make its handling during swinging out easier.

Thus the front jaw 7 forms together with the adjusting plate 5, a jaw unit 27 movable on the guide rail 2.

Figure 4:
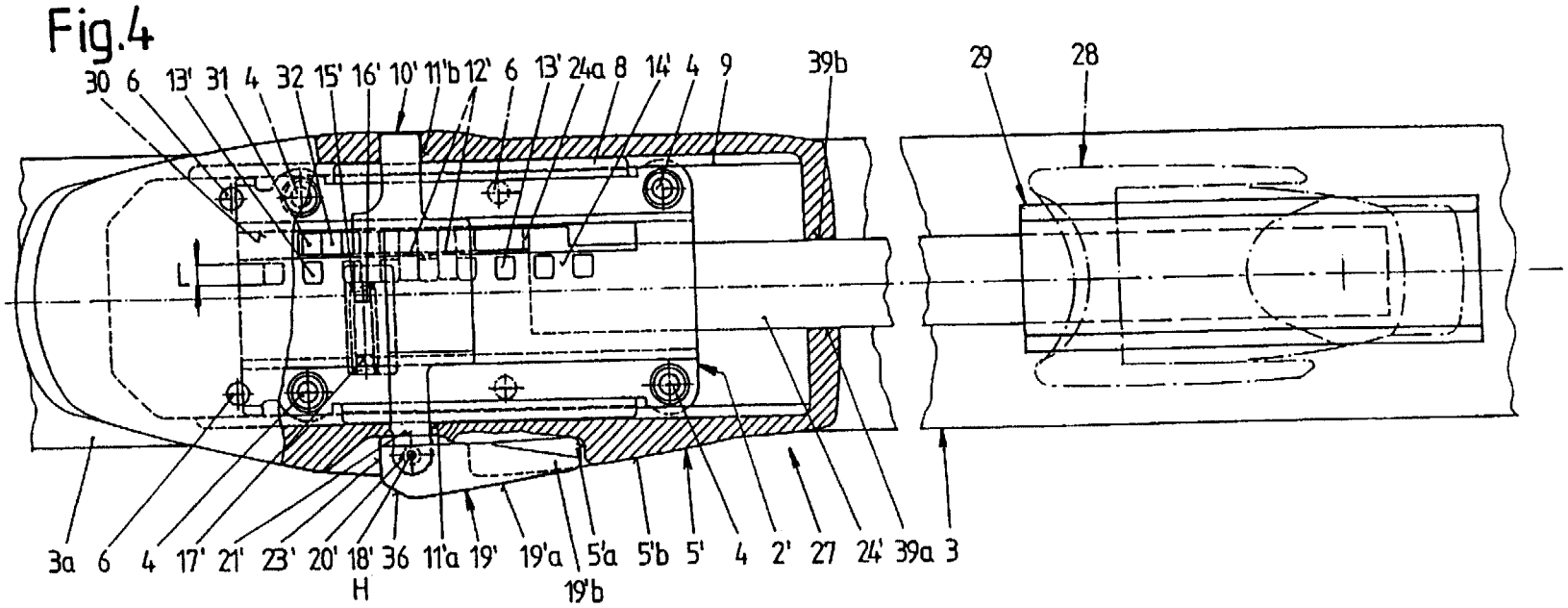
FIG. 4 is a partially cross-sectional top view of another embodiment.

FIG. 4 shows another embodiment of a device for the longitudinal adjustment of the front jaw 7 and of a heel holder 28, which is movably guided, however, secured against a lifting off, in a rear ski-fixed guide rail 29, and is lockingly connected through a connecting band 24' to the only partly illustrated jaw unit 27. The connecting band 24' is for this purpose guided at its front end in a U-shaped recess 30 of the front guide rail 2', and has several locking teeth 31 on its upper side, the tooth gaps between the locking teeth form complementary locking recesses 32. Just like in the embodiment according to FIGS. 1 to 3, the locking part 10' is movably supported transversely with respect to the longitudinal axis of the ski in guideways 11'a, 11'b, which locking part has on its underside two locking teeth 12' with twice the length L of the two locking teeth 12 according to FIG. 2, which in the locked state (see FIG. 4) of the locking part 10' engage on one side the locking recesses 32 of the connecting band 24' and on the other side complementary locking recesses 14' of the guide rail 2', which recesses are formed by several locking teeth 13'. The locking teeth 13' are thereby arranged on the upper side of the guide rail 2' and parallel to the locking teeth 31 of the connecting band 24'. The locking teeth 13' and 31 have each a single length L. A spring 15', in the form of a compression spring, holds the locking part 10' in the locked position and is held on one side by an extension 16' of the locking part 10' and on the other side on a peg 17' of the adjusting plate 5', and is supported by the locking part 10' or adjusting plate 5'. The locking part 10' is guided laterally out of the adjusting plate 5' and carries at its end section an operating member 19' designed like a rocking lever, which is inserted by means of a pin 18' into a bore 20' of the locking part 10' and thus is pivotal about a vertical axis H.

The operating member 19' has a first surface section 22', which in the illustrated locking position (see FIGS. 4, 4a), resting on a lateral section 21' of the adjusting plate 5'. At a right angle to the first surface section 22' extends a second surface section 23', which merges from the first surface section 22' by a steep curve 33 of an eccentric. A first support point 34 rests on this steep curve 33, about which point the operating member 19' can be pivoted from the first surface section to the second surface section and vice versa. A third surface section 36 follows the second surface section 23' forming an obtuse angle β of 120°–155°, in particular an angle of 140°, through a further steep curve 35, whereby a second support point 37 rests on this steep curve 35.

Figure 4A:
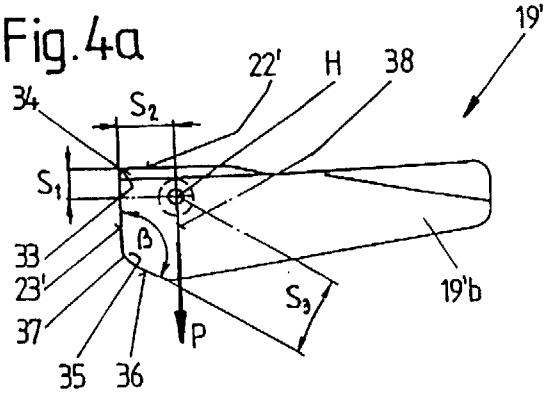
FIG. 4*a* shows a detail of FIG. 4 in an enlarged scale.

The normal distances between the individual surface sections 22', 23', 36, with reference to the pin 18', are one after the other identified with $S_1$, $S_2$, $S_3$ (see in particular FIG. 4a). The difference between the normal distances $S_2$ and $S_1$ is thereby the same size or greater than the length L of the locking teeth 13' of the connecting band 24', and the difference between the normal distances $S_3$ and $S_2$ is of the same size or greater than the length L of the locking teeth 13' of the front guide rail 2'.

During the first swinging out of the operating member 19' over the first support point 34, operating member 19' slides on the lateral section 21' of the adjusting plate 5', whereby the locking part 10' moves in direction of an arrow P. As soon as the support point 34 passes a normal plane 38 extending through the pin 18', the operating member 19' moves again into a stable position, whereby now the second surface section 23' rests on the lateral section 21' of the adjusting plate 5', so that the locking teeth 12' of the locking part 10' disengage from the locking recesses 32 of the connecting band 24' through the first swinging out of the operating member 19'. The heel holder 28 connected to the connecting band 24' can now be adjusted to a desired boot size along the rear guide rail 29. During a further swinging out of the operating member 19' over the second support point 37, the third surface section 36 rests on the lateral section 21' of the adjusting plate 5', so that the locking teeth 12' of the locking part 10' will now also disengage from the locking recesses 14' of the front guide rail 2'. In this manner, it is possible to move the front jaw 7 in the front guide rail 2' and the heel holder 28 in the rear guide rail 29 and thus to not only adjust them to a desired boot size but to also move them into a central ski position. The locking or unlocking is accomplished by the above-discussed differences between the normal distances $S_2-S_1$ or $S_3-S_2$.

When the adjusting operation has been concluded, the operating member 19' is pivoted in the opposite direction compared with the unlocking process and is thus moved back into the original position. This position is illustrated in FIG. 4.

The connecting band 24' is supported laterally and upwardly in the area of the heel holder 28 by guides, not illustrated. The connecting band 24' is angled, in steps, in the area of the adjusting plate 5' and is guided in guides 39a, 39b on both sides, and is bent upwardly at the point 24a, so that the locking teeth 31 lie at the same height as the locking teeth 13' of the guide rail 2'.

In order to prevent the operating member from unintentionally swinging out, for example, during parking of the ski by the penetration of a braking mandrel of a ski parked besides it into the gap between the handle bar of the operating member and the adjusting plate, the variations of safety devices in the area of the operating member illustrated in FIGS. 5 to 8 can be provided.

Figure 5:
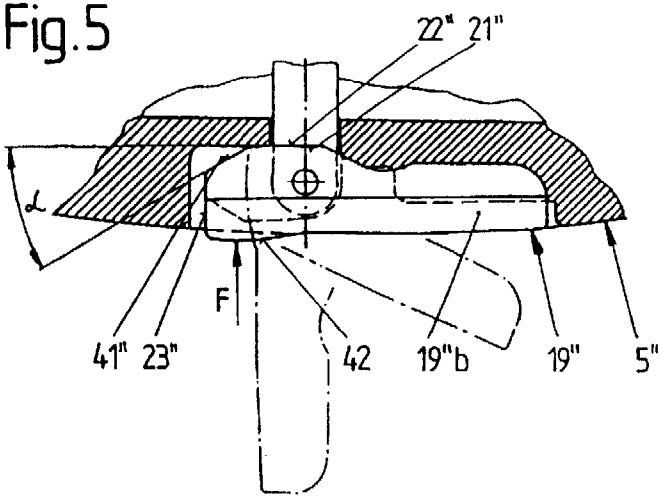

FIG. 5 illustrates a first embodiment of a secured operating member 19'', which, in comparison with the operating member 19, $19^{I}$ illustrated in FIGS. 1 and 4, has a gripping bar $19^{II}b$ extending with a constant width up to the end area, which bar prevents a braking mandrel from penetrating. In order for the operating member $19^{II}$ to be able to be swung out, an additional surface section $41^{II}$ is provided between the first and the second surface section $22^{II}$ and $23^{II}$, which surface section $41^{II}$ assumes an acute angle α of 15° to 25°, preferably 20°, with respect to the lateral section $21^{II}$ of the adjusting plate $5^{II}$ in the swung in position of the operating member $19^{II}$. By pressing the thumb in direction of the arrow F, the additional surface section 41 rests on the lateral section $21^{II}$, and thus the operating member $19^{II}$ is swung into the first position illustrated in dash-dotted lines. The operating member can now be swung with the help of fingers into the end position also illustrated by dash-dotted lines. The operating member $19^{II}$ has in the front area an arch 42 for easier pressing.

Figure 6:
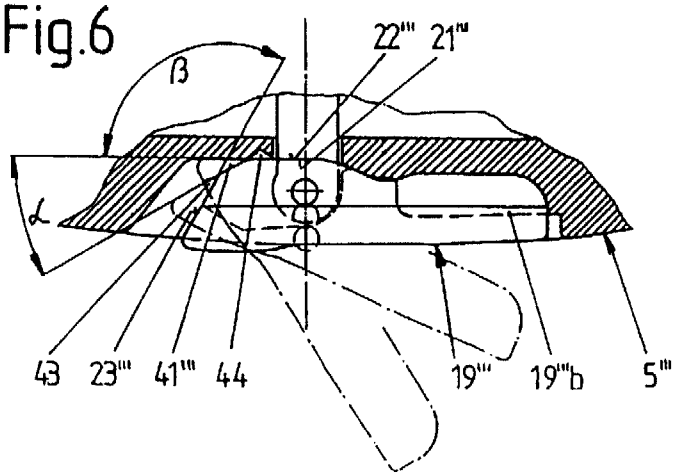

FIG. 6 illustrates a second embodiment of a secured operating member $19^{III}$, which essentially is the same as the one in FIG. 5, however, whereby the second surface section $23^{III}$ extends relative to the first surface section $22^{III}$ at an angle of 105° to 135°, preferably 120°. Furthermore, a locking nose 43 is mounted at the transition area between the additional surface section $41^{III}$ and the second surface section $23^{III}$, which locking nose engages a locking recess 44 of the lateral section $21^{III}$ of the adjusting plate $5^{III}$ when the operating member $19^{III}$ is swung out.

Figure 7:
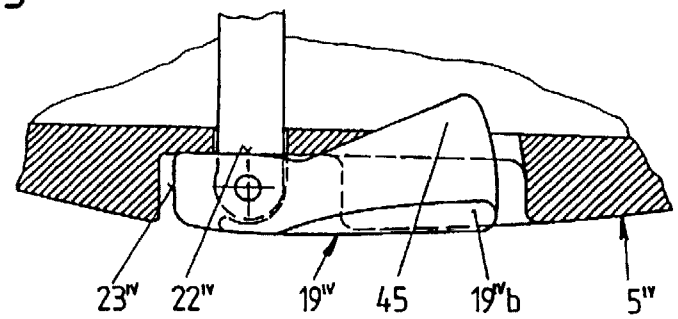
FIGS. 5 to 8 are top views of various embodiments of an operating member.

FIG. 7 illustrates a third embodiment of a secured operating member $19^{IV}$, in which the first and second surface sections $22^{IV}$ or $23^{IV}$ form a right angle with one another like in the examples according to FIGS. 1 and 4. The area of the handle bar $19^{IV}b$ is followed starting from the operating member $19^{IV}$ by a disk segment 45, which, in the swung in position of the operating member $19^{IV}$, lies freely movably underneath a slide plate of the front jaw, which slide plate is indicated in FIG. 1 only by dash-dotted lines, thereby causing the gap between the operating member $19^{IV}$ and the adjusting plate $5^{IV}$ to be covered.

Figure 8:
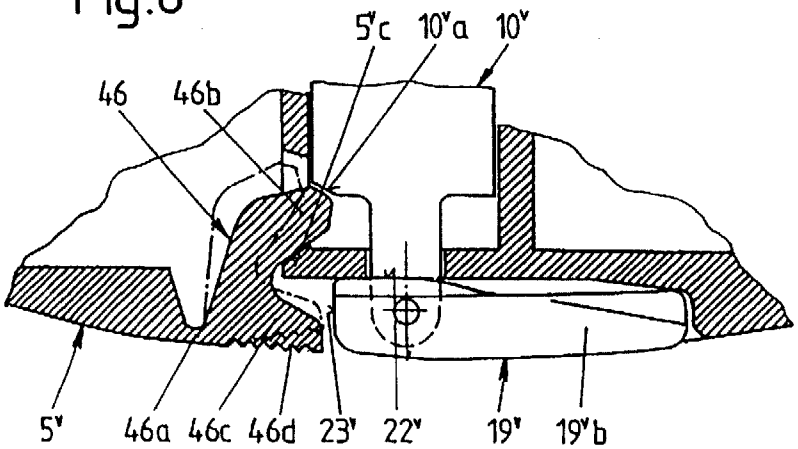

FIG. 8 illustrates a fourth embodiment of a secured operating member $19^{V}$ designed similar to FIGS. 1 and 4. To secure the operating member $19^{V}$, it has a toggle-leverlike blocking member 46 positioned in front of it, which is designed in one piece with the adjusting plate $5^{V}$ and is connected to said latter through a narrow web 46*a*. The one arm 46*b* of the toggle-leverlike blocking member 46 is in the illustrated secured position supported on the one side on an inclined surface $10^{V}a$ of the locking part $10^{V}$ and on the other side on a projection $5^{V}c$ of the adjusting plate $5^{V}$. The other arm 46*c* of the toggle-leverlike blocking member 46 is designed as a push element 46*d*. When the push element 46*d* is pressed in with the thumb, the narrow web 46*a* yields resiliently and the toggle-leverlike blocking member 46 is moved into the position illustrated by dash-dotted lines, thus causing the locking part $10^{V}$ to be released and the operating member $19^{V}$ to be able to be swung out.

Figure 9:
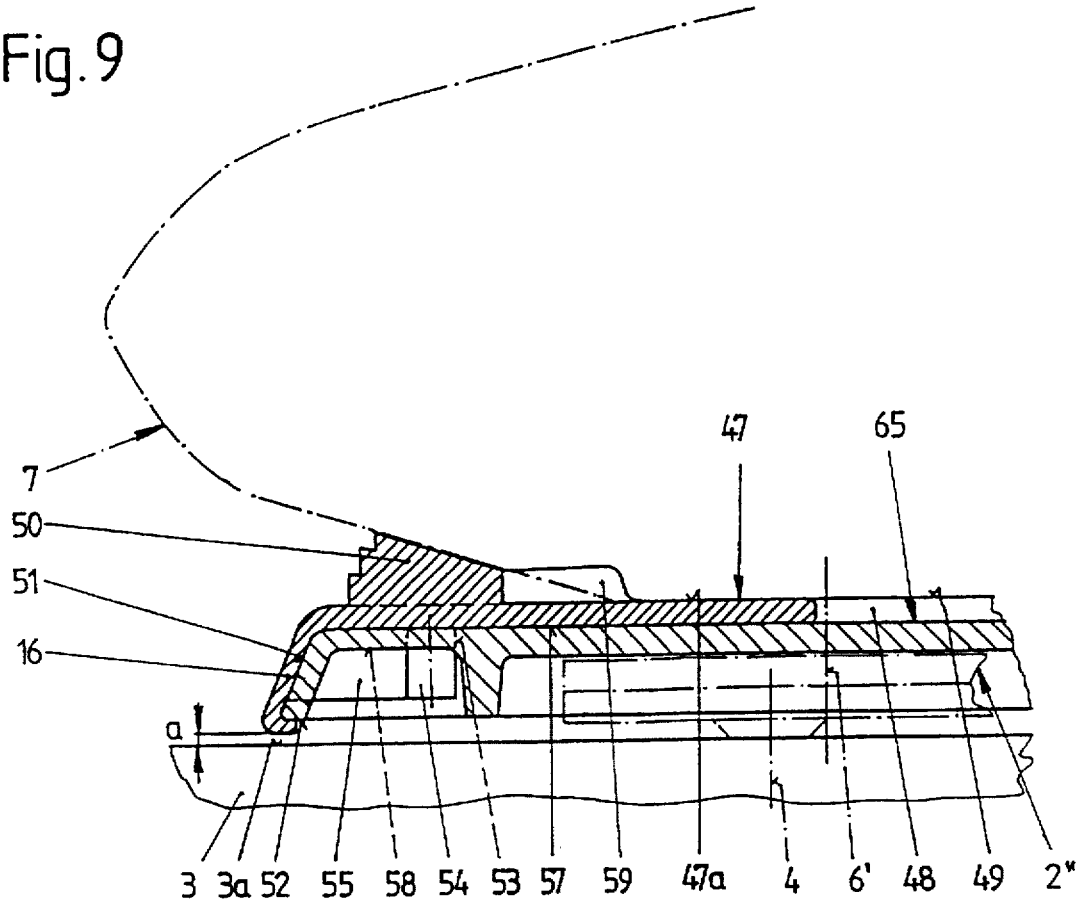
FIG. 9 is a longitudinal center cross-sectional view of a first embodiment of a damping device of the invention.

Reference numeral 3 in FIG. 9 identifies the ski, on which the guide rail $2^{II}$, which is approximately U-shaped in cross section, is fastened by means of screws 4, which are only indicated and not illustrated. An adjusting plate 65 is longitudinally movably supported in the guide rail $2^{II}$ and can be fixed with locking mechanisms, which are not illustrated. A front jaw 7 is fastened on the adjusting plate 65 by means of screws $6^{I}$, which are only indicated. A damping device in the form of a damping insert 47 is arranged between the front end section of the adjusting plate 65 and the front jaw 7. The damping insert 47 is embedded in a trough-shaped recess 48 of the adjusting plate 65 and has a base 50, on which the front jaw 7 is supported. The recess 48 extends over the front side 51 of the adjusting plate to the lower edge 52. The damping insert 47 extends thereby over the front side 51 and the lower edge 52 at a distance "a" with respect to the upper side of the ski 3*a*, whereby the distance "a" is approximately 0.5–1 mm. The adjusting plate 65 has below the base 50 on both sides of the longitudinal center axis two bores 53 for two pegs 54, which start from the damping insert 47 and are directed downwardly. A web 55 is formed on each peg 54, which web is connected to the front-side section 56 and the underside 57 of the damping insert 47. Accordingly, a slot 58 in the adjusting plate 65 starts out from each one of the bores 53, which slot exits at the front side 51. With this arrangement it is easily possible to insert the damping insert 47 into the recess 48 and to secure same against movement in a longitudinal direction.

Figure 10:
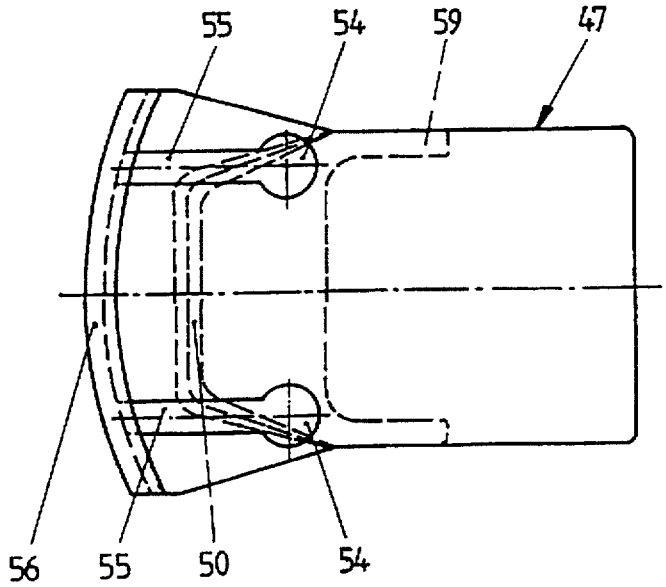
FIG. 10 is a bottom view of a damping insert illustrated in FIG. 9.

Cover bars 59 are arranged on both sides on the upper side 47*a* of the damping insert 47, which cover bars start out from the base 50 and closely join or contacts the front jaw 7 so that a lateral protection against the penetration of snow or ice is guaranteed. FIG. 10 shows that the damping insert 47 widens continuously in a lateral direction in the front end section.

Figure 11:
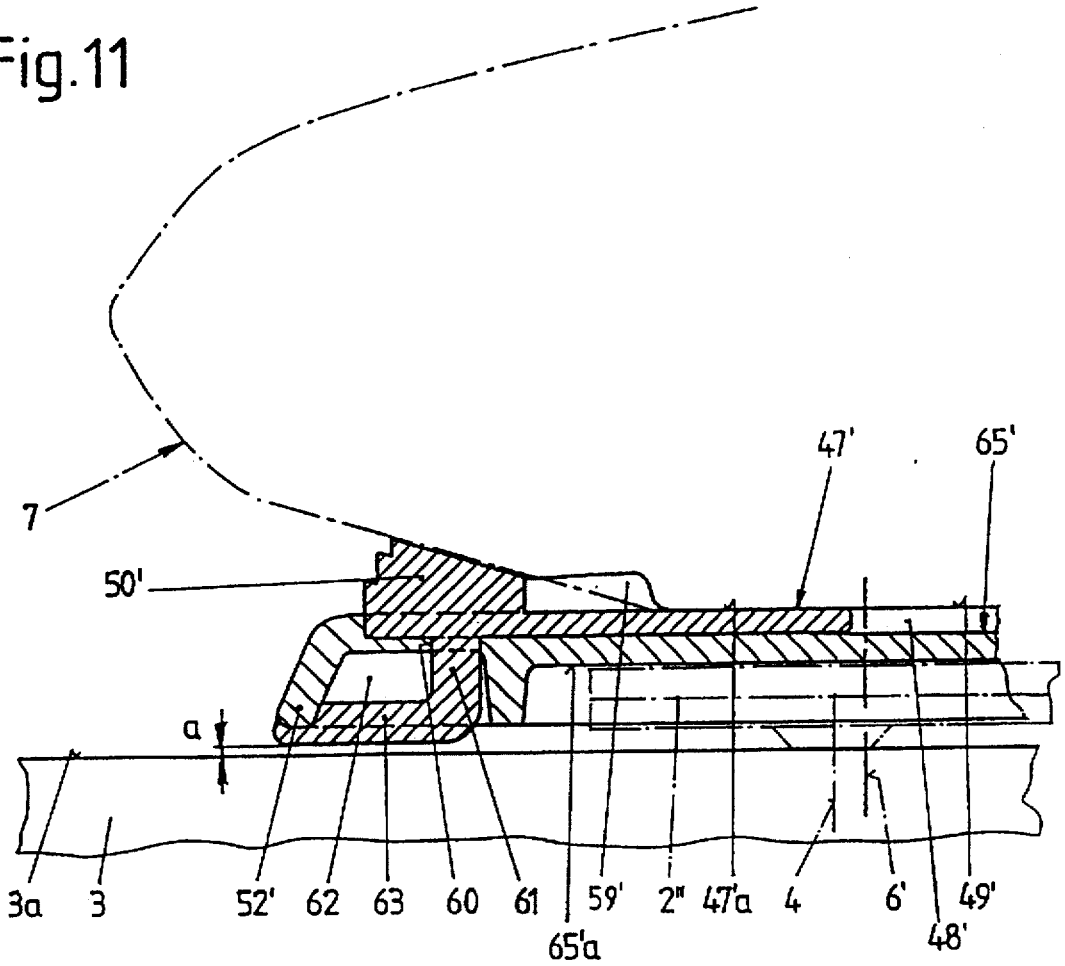
FIG. 11 is a longitudinal center cross-sectional view of a second embodiment of a damping device of the invention.
Figure 12:
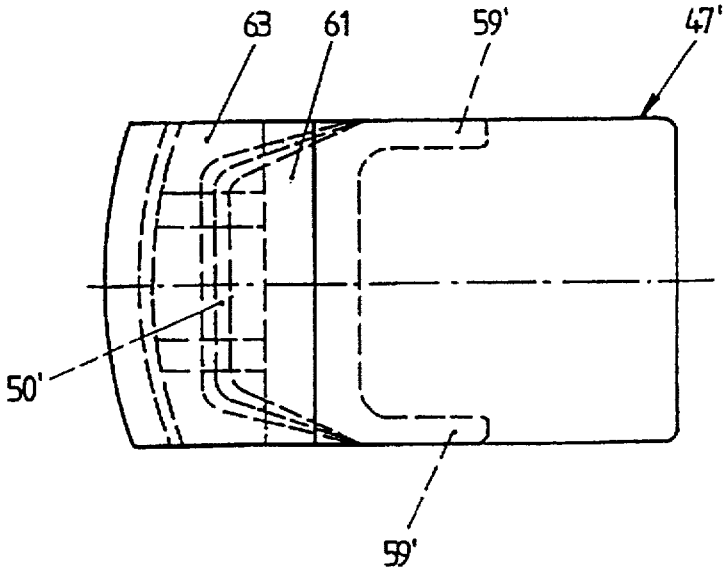
FIG. 12 is a bottom view of a damping insert illustrated in FIG. 11.

The embodiment according to FIGS. 11 and 12 differs from the one according to FIGS. 9 and 10 only in such a manner that as a protection against movement of the damping insert $47^{I}$ in longitudinal direction of the ski, the adjusting plate $65^{I}$ has in the area of the base $50^{I}$ an elongated opening extending transversely with respect to the longitudinal direction of the ski. A tongue 61 starting out from the damping insert $47^{I}$ projects through the opening 60 and extends thereafter at a right angle and at a distance "a" with respect to the upper side of the ski 3*a* forwardly to the lower edge $52^{I}$ of the adjusting plate $65^{I}$. Two ribs 62 are arranged on the underside $65^{I}a$ of the adjusting plate $65^{I}$ on both sides of the longitudinal center axis, which ribs rest on the forwardly extending section 63 of the tongue 61 so that a pressure applied to the adjusting plate $65^{I}$ can be transferred to the tongue 61. The arrangement and design of the base $50^{I}$ and of the cover bars $59^{I}$ on both sides corresponds with the ones of FIGS. 9 and 10.

It is understood that the embodiments of an operating member illustrated in FIGS. 5 to 8 can also be applied in the embodiment according to FIG. 4.

The invention has been described in detail in connection with a ski-binding part designed as a front jaw, however, the measures of the invention can also be applied in a ski-binding part designed as a heel holder.

In order to increase the damping action, it is possible in both embodiments to design the assembly height of the damping insert in the area of contact with the front jaw slightly higher, so that the damping insert during assembly of the front jaw with the adjusting plate is precompressed.

We claim:

1. A device for the longitudinal adjustment of a ski-binding part, comprising a guide rail adapted to be fastened on an upper side of a ski, and on which the ski-binding part is guided in a longitudinal direction of the ski as a movable jaw unit with locking means being provided for fixing the movable jaw unit in a selected longitudinal position on the guide rail, said locking means including a locking part which is movably guided at a right angle with respect to the guide rail on the jaw unit, and has an operating member hinged to said locking part, the operating member through the force of a spring holding the locking part in a form-locking engagement selectively with one of a plurality of complementary locking recesses of the guide rail, the recesses being arranged one behind the other in the longitudinal direction of the ski, the operating member having at least two surface sections, a second surface section of the at least two surface sections extending relative to a first surface section of the at least two surface sections at an angle (β), the angle (β) being generally equal to or greater than 90°, and the second surface section lies farther from the locking part than the first surface section, and thus the first surface section determines a locked position and the second surface section determines an unlocked position of the locking part, wherein the movable jaw unit has an adjusting plate with a front jaw releasably fastenable thereon and the locking mechanism is arranged in the adjusting plate, wherein both the locking part and the complementary locking recesses extend horizontally, wherein the operating member for disengaging the locking part from the complementary locking recesses is arranged pivotally about a vertical axis on the locking part, the operating member being supported by one of the at least two surface sections on a lateral section of the adjusting plate, which lateral section faces the operating member, wherein an adjusting plate recess is provided in the adjusting plate and receives therein the operating member in a swung-in position locking the locking part in a selected locking recess, and wherein the adjusting plate has on both sides a guide for the locking part, and the two guides are generally aligned with one another.

2. The device according to claim 1, wherein the vertical axis is arranged on the locking part so that the operating member, which is in the swung-in position within the recess, extends with an outside thereof essentially flush with an outer contour of the adjusting plate.

3. The device according to claim 1, wherein the operating member has a third surface section, wherein the guide rail guiding the jaw unit is arranged as a front guide rail section of the guide rail, wherein a rear guide rail section is fixed on the ski for securing a heel holder of the ski binding, wherein a connecting band is arranged within the adjusting plate having the heel holder fixedly secured thereto, the connecting band being guided within the rear guide rail section, wherein the locking part is lockable in the locked position of the jaw unit on the front guide rail section and has two active positions, whereby in the first active position both the jaw unit and the connecting band are freely movable on the front guide rail section, whereas in the second active position only the jaw unit is locked and the connecting band together with the heel holder moves in the longitudinal direction of the ski and is lockable in a selected one of the longitudinal positions.

4. A ski-binding part according to claim 3, wherein the third surface of the operating member extends through a further steep curve at an obtuse angle (β) in a range of 120°–155° with respect to the second surface, and that a second support point lies on said steep curve.

5. The ski-binding part according to claim 4, wherein a pin is positioned at a horizontal axis pivotally connecting the operating member to the locking part, wherein a first distance extends normal to the first surface section to the pin, wherein a second distance extends normal to the second surface section to the pin, wherein a third distance extends normal to the third surface section to the pin, wherein a first difference between the second distance and the first distance is equal to or greater in length than second locking teeth of the connecting band, and a second difference between the third distance and the second distance is equal to or greater in length than first locking teeth of the front guide rail section, wherein the length of individual locking teeth projects through the length of the locking recesses of the guide rail and extends also into one of a plurality of locking recesses of the connecting band between the second locking teeth, the length of the individual locking teeth corresponds essentially to a sum of the lengths of the locking recesses of the front guide rail section and the connecting band.

6. The ski-binding part according to claim 1, wherein an additional surface is provided between the first and second surface sections, which in the swung-in position of the operating member has an acute angle (α) of 15° to 25° with respect to the lateral section of the adjusting plate.

7. The ski-binding part according to claim 6, wherein a locking nose is mounted on the second surface section at a transition area between the additional surface section and the second surface section, the locking nose engages a locking recess in the lateral section when the operating member swings out of the lateral section of the adjusting plate.

8. The ski-binding part according to claim 1, wherein the front jaw has a slide plate, and wherein the operating member has a handle bar and a disk segment, the disk segment follows adjacent the handle bar and lies freely movably below the slide plate of the front jaw when the operating member is in the swung-in position.

9. The ski-binding part according to claim 1, wherein the adjusting plate has a toggle-leverlike blocking member at a section thereof in front of the operating member, the blocking member is one piece with the adjusting plate joined through a narrow web thereto, whereby a first arm of the toggle-leverlike blocking member is supported on one side thereof on a sloped surface the locking part and on another side thereof on a projection of the adjusting plate, and wherein a second arm of the toggle-leverlike blocking member is a push element.

10. The device according to claim 1, wherein a damping insert is positioned between the front jaw and a front end section of the adjusting plate, the damping insert is of an elastic material and is secured in the adjusting plate against movement in the longitudinal direction relative to a ski.

11. The device according to claim 10, wherein the damping insert is embedded in a recess in an upper side of the adjusting plate, and wherein the front jaw is supported on a base of the damping insert, the base projecting beyond the upper side of the adjusting plate.

12. The device according to claim 11, wherein the recess extends beyond a front side of the adjusting plate to a lower edge thereof, wherein the damping insert extends over the front side and the lower edge adapted to be spaced a distance from the upper side of the ski, wherein the adjusting plate has at least one bore for at least one downwardly directed peg starting out from the damping insert below the base and a web formed on the peg, the web being connected to a frontside section and an underside of the damping insert, wherein the adjusting plate has a slot for the peg to move through, the slot extending from the bore and exiting at the front side.

13. The device according to claim 11, wherein the adjusting plate has, in the area of the base, an elongated opening adapted to extend transversely with respect to the longitudinal direction of the ski, a tongue projecting downwardly through the opening starting from the damping insert and extending at a right angle forwardly at a select distance above the upper side of the ski to the lower edge of the adjusting plate, and wherein at least one rib is arranged on an underside of the adjusting plate, the rib resting on a forwardly extending section of the tongue.

14. The device according to claim 12, wherein cover bars are arranged on both sides of an upper side of the damping insert, the cover bars extending from the base and closely contacting the front jaw.

15. The ski-binding part according to claim 3, wherein the third surface and the second surface of the operating member are joined at a further curve which defines an angle of about 140°.

* * * * *